US011479987B2

(12) United States Patent
Snare

(10) Patent No.: US 11,479,987 B2
(45) Date of Patent: Oct. 25, 2022

(54) HEATING APPARATUS FOR POOL LINER REPAIR AND METHOD

(71) Applicant: Rayman Snare, Oregon, OH (US)

(72) Inventor: Rayman Snare, Oregon, OH (US)

( * ) Notice: Subject to any disclaimer, the term of this patent is extended or adjusted under 35 U.S.C. 154(b) by 73 days.

(21) Appl. No.: 16/810,036

(22) Filed: Mar. 5, 2020

(65) Prior Publication Data

US 2020/0284060 A1 Sep. 10, 2020

Related U.S. Application Data

(60) Provisional application No. 62/814,081, filed on Mar. 5, 2019.

(51) Int. Cl.
*E04H 4/14* (2006.01)

(52) U.S. Cl.
CPC ..... *E04H 4/14* (2013.01); *E04H 2004/146* (2013.01)

(58) Field of Classification Search
CPC ..... E04H 4/14; E04H 2004/146; E04H 2004/147; A47K 3/287; B05B 1/207
USPC ..... 4/229, 569
See application file for complete search history.

(56) References Cited

U.S. PATENT DOCUMENTS 536,020 A * 3/1895 Ebert ..... A47K 3/287 4/618
1,758,767 A * 5/1930 Taggart ..... B05B 1/207 239/556
2,161,047 A * 6/1939 Holden ..... A47K 3/287 4/618
2,240,611 A * 5/1941 Derdeyn ..... B05B 1/207 239/267
2,590,026 A * 3/1952 Marx ..... A61H 35/00 4/524
2,854,150 A * 9/1958 Shea, Jr. ..... B65H 3/322 414/796
3,373,740 A * 3/1968 Riepl ..... A61H 33/025 601/168
4,562,963 A * 1/1986 Butler ..... B05B 1/207 239/266
4,600,153 A * 7/1986 Stone ..... F28G 1/166 239/560
5,205,306 A * 4/1993 Peterson ..... A47K 3/287 134/104.2
5,230,472 A * 7/1993 McCabe ..... B05B 1/185 239/443
5,312,047 A * 5/1994 Akers ..... B05B 1/14 239/276

(Continued)

*Primary Examiner* — David P Angwin
*Assistant Examiner* — William R Klotz
(74) *Attorney, Agent, or Firm* — MacMillan, Sobanski & Todd, LLC

(57) ABSTRACT

A heating tool for thermally manipulating an installed pool liner layer includes a manifold portion and a heat supply portion. The manifold portion forms a closed-loop passageway having a wall and a thermal distribution rail that includes a plurality of heat ports extending through the wall. The manifold portion is structured to pass between an installed pool liner layer and a supporting side wall and permitting manipulation and movement of the heating tool between the pool liner and the side wall. A heat supply portion includes a handle with a co-axially formed inlet passage in fluid communication with a fluid line connection that connects the inlet passage with a heated fluid source.

8 Claims, 6 Drawing Sheets

(56) References Cited

U.S. PATENT DOCUMENTS

| | | | | |
|---|---|---|---|---|
| 6,079,640 | A * | 6/2000 | Merritts | B05B 1/202 239/722 |
| 6,302,335 | B1 * | 10/2001 | Ormiston | B05B 3/06 239/285 |
| 8,979,778 | B2 * | 3/2015 | Faredoun | B05B 1/18 4/615 |
| 9,061,299 | B1 * | 6/2015 | Fodor | B05B 13/0207 |
| 9,533,313 | B2 * | 1/2017 | Anderson | B05B 1/207 |
| 9,999,894 | B2 * | 6/2018 | Becktell | B05B 1/3026 |
| 10,940,499 | B2 * | 3/2021 | Pletcher | B05B 15/62 |

* cited by examiner

HEATING APPARATUS FOR POOL LINER REPAIR AND METHOD

CROSS-REFERENCE TO RELATED APPLICATIONS

This application claims the benefit of U.S. Provisional Application No. 62/814,081, filed Mar. 5, 2019, the disclosure of which is incorporated herein by reference in its entirety.

BACKGROUND OF THE INVENTION

This invention relates in general to vinyl liner pools and in particular to an apparatus and method to repair installed pool liners.

Vinyl liners have proven to be popular and well-suited structures for constructing in-ground and above-ground swimming pools. These liners are cost effective, reasonably durable, and simple to install, particularly when compared to competing in-ground installations such as gunite, concrete, or fiberglass structures. Vinyl liners are subject to damage, particularly over time, as the physical properties of the liner changes due to environmental and chemical exposure. Over time the liners may become harder, brittle, and shrink causing them to detach from the outer cove molding that retains the upper surface to the pool superstructure. Once detached, the superstructure is exposed to water damage and the liner is more subject to tearing, which may cause a major failure of the pool, in addition to ruining the aesthetics of the pool.

It is important to repair and reinstall the liner before additional damage results. Since vinyl is a thermoplastic material, subsequent heating of the material will reintroduce pliability sufficiently to permit reforming of the liner to the pool perimeter. Traditionally, this process involves applying heat by the use of hot air equipment or pouring hot water between the liner and the perimeter structure. This process, however, has proven to be difficult to control and requires significant experience and attention to detail in order to avoid over heating the material and causing a melt-through condition or not applying enough heat and causing a tear during the reinstallation process. Thus, it would be desirable to provide an apparatus and a method that give more control over the application of heat to localized areas of the liner, particularly areas located toward the lower portions of the liner.

SUMMARY OF THE INVENTION

This invention relates to a heating tool for thermally manipulating an installed pool liner layer. The tool has a manifold portion and a heat supply portion. The manifold portion has a wall and a thermal distribution rail that includes a plurality of heat ports extending through the wall. The manifold portion is shaped to pass between the installed pool liner layer and a supporting pool side wall. The manifold portion permits manipulation and movement of the heating tool between the pool liner and the side wall. The heat supply portion includes a handle with a co-axially formed inlet passage. The inlet passage is in fluid communication with a fluid line connection that connects the inlet passage with a heated fluid source.

The manifold portion may include a return rail configured to create a closed-loop heated fluid passageway. In one embodiment, the return rail is in fluid communication with the inlet passage. In one embodiment, the manifold portion is a tubing-formed loop. In another embodiment, the manifold portion includes an outer body configured in a paddle shape and having a tapered insert tip. The paddle-shaped outer body has a median perimeter line that defines a surface contour from the outer body edge to a paddle face surface that facilitates insertion between the pool liner layer and the supporting side wall, both above and below a water line level.

The handle terminates in a grip that facilitates inserting and manipulating the manifold portion between the pool liner and the side wall. The handle may be insulated against heat emanating from the inlet tube to a user's hand. In one embodiment, the manifold portion is formed as a fluid supply half and a backing half. These two halves are attached together to define the distribution rail and an inlet passage. The inlet passage of the manifold portion forms a fluid connection with the inlet passage of the handle portion.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1A:
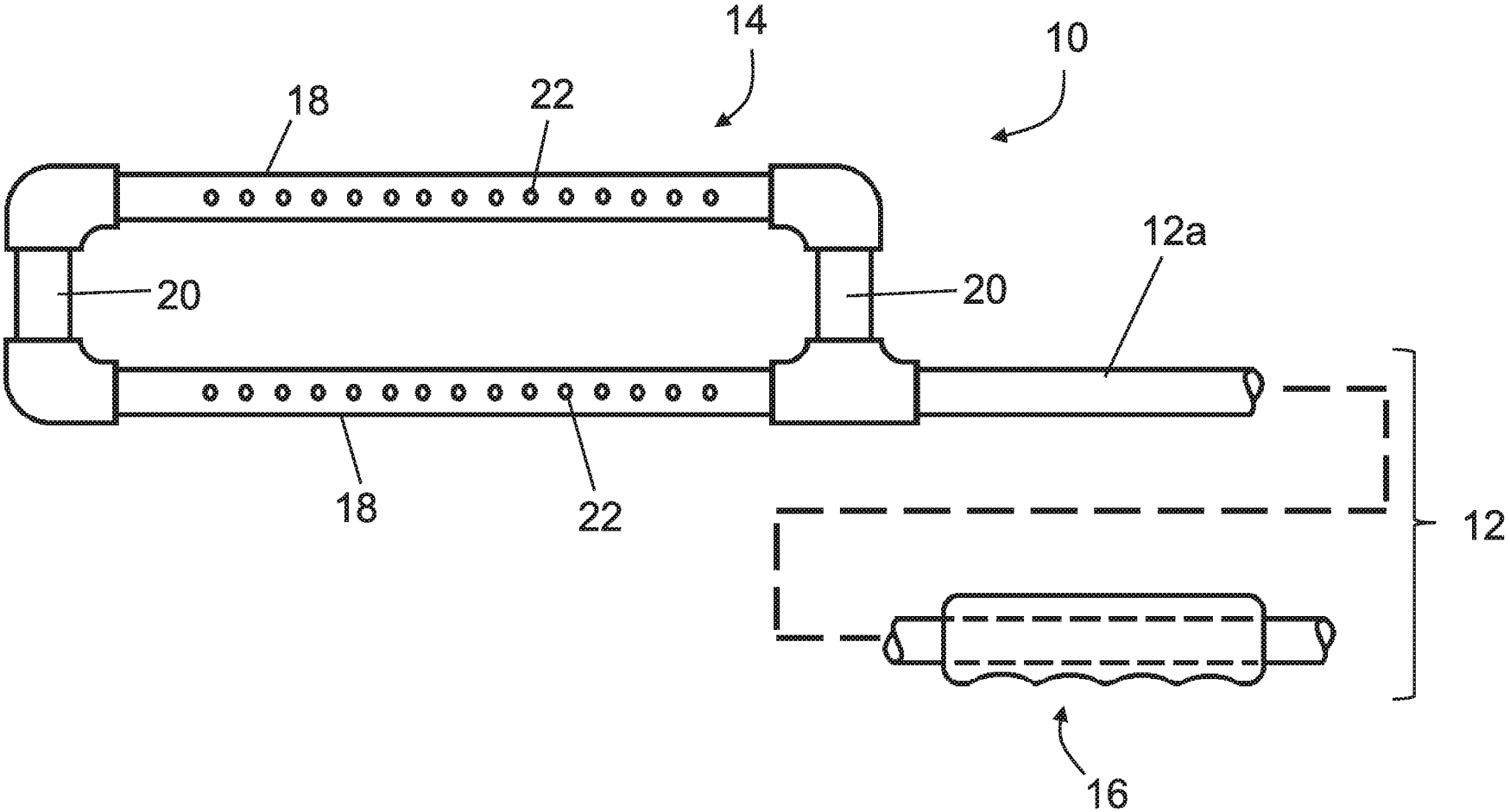
FIG. 1A is a first embodiment of a pool liner heating tool in accordance with the invention.
Figure 4:
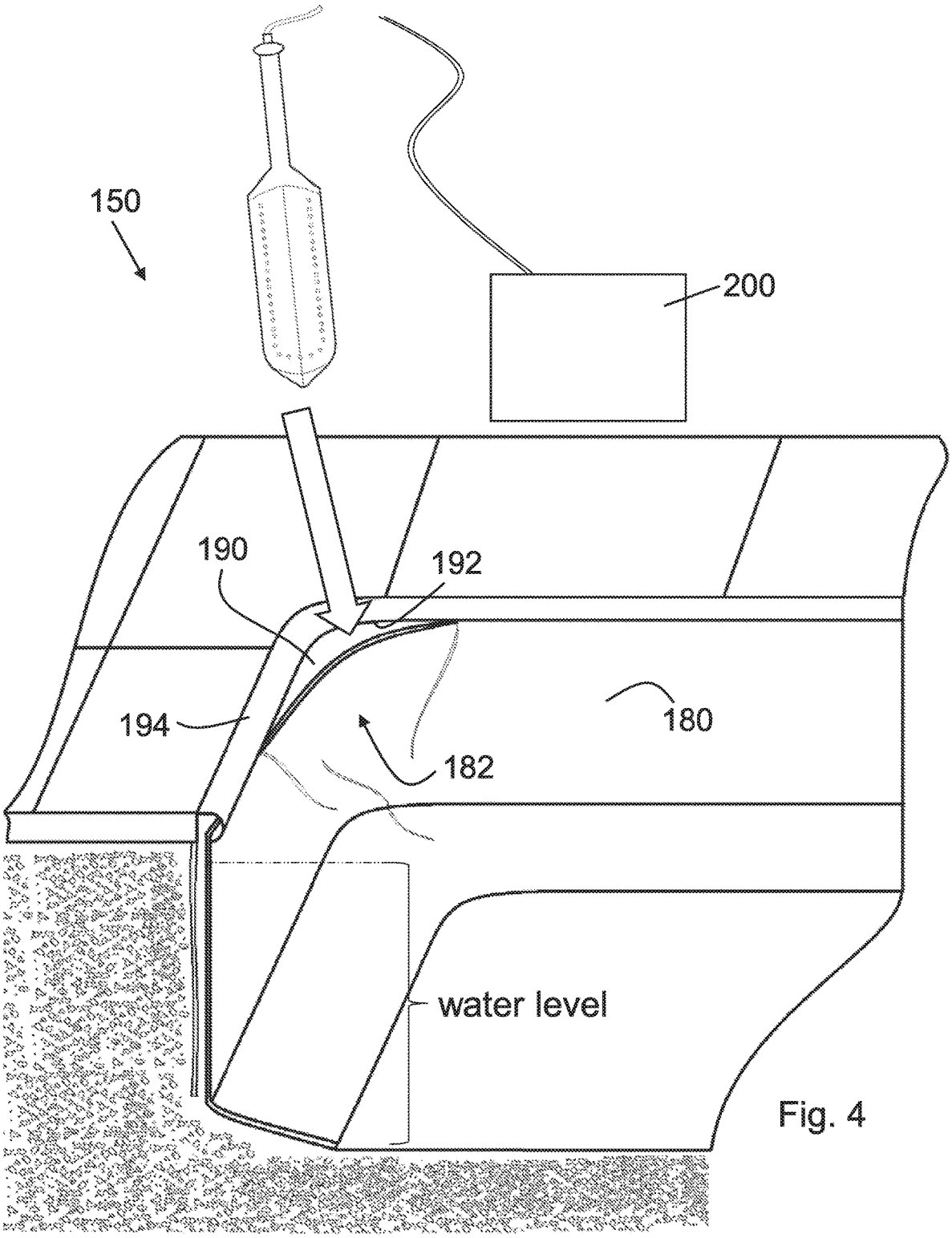
FIG. 4 is a perspective view of a method of using an embodiment of the pool liner heating tool in accordance with the invention.

Referring now to the drawings, there is illustrated in FIG. 1 a pool liner heating tool, shown generally at 10. The heating tool 10 includes a heat supply portion 12 and a manifold portion 14. In the illustrated embodiment, the manifold portion 12 is illustrated as a tubular structure having a generally circular cross sectional shape. In other variations of the illustrated embodiment, the manifold portion 14, and the heat supply portion 12 may have any suitable geometric cross section comprising oval, rectangular, teardrop, or elliptical shapes, alone or in combination with other cross sectional geometries. The heat supply portion 12 includes an inlet tube 12*a* and may also include a handgrip 16 to serve as a handle for inserting and manipulating the heating tool 10 between a pool liner and a perimeter support structure, as shown in FIG. 4. The handgrip 16 may be configured to insulate the user from heat emanating from the inlet tube 12*a*. The inlet tube 12*a* fluidly connects a heated fluid source 200, shown in FIG. 4, to the manifold portion 14.

The manifold portion 14 forms a closed loop structure comprising a thermal distribution rail 18 and may optionally include at least one return rail 20. The thermal distribution rail 18 includes a plurality of heat ports 22 that extend through one wall of the manifold portion 14. The return tubes 20 may include heat distribution ports 22 if so desired. The heat ports 22 permit metered flow of heated fluid, which may be a liquid or gas, such as hot water, steam, hot air or any combination thereof, to be applied between a pool liner and the supporting structure.

Figure 1B:
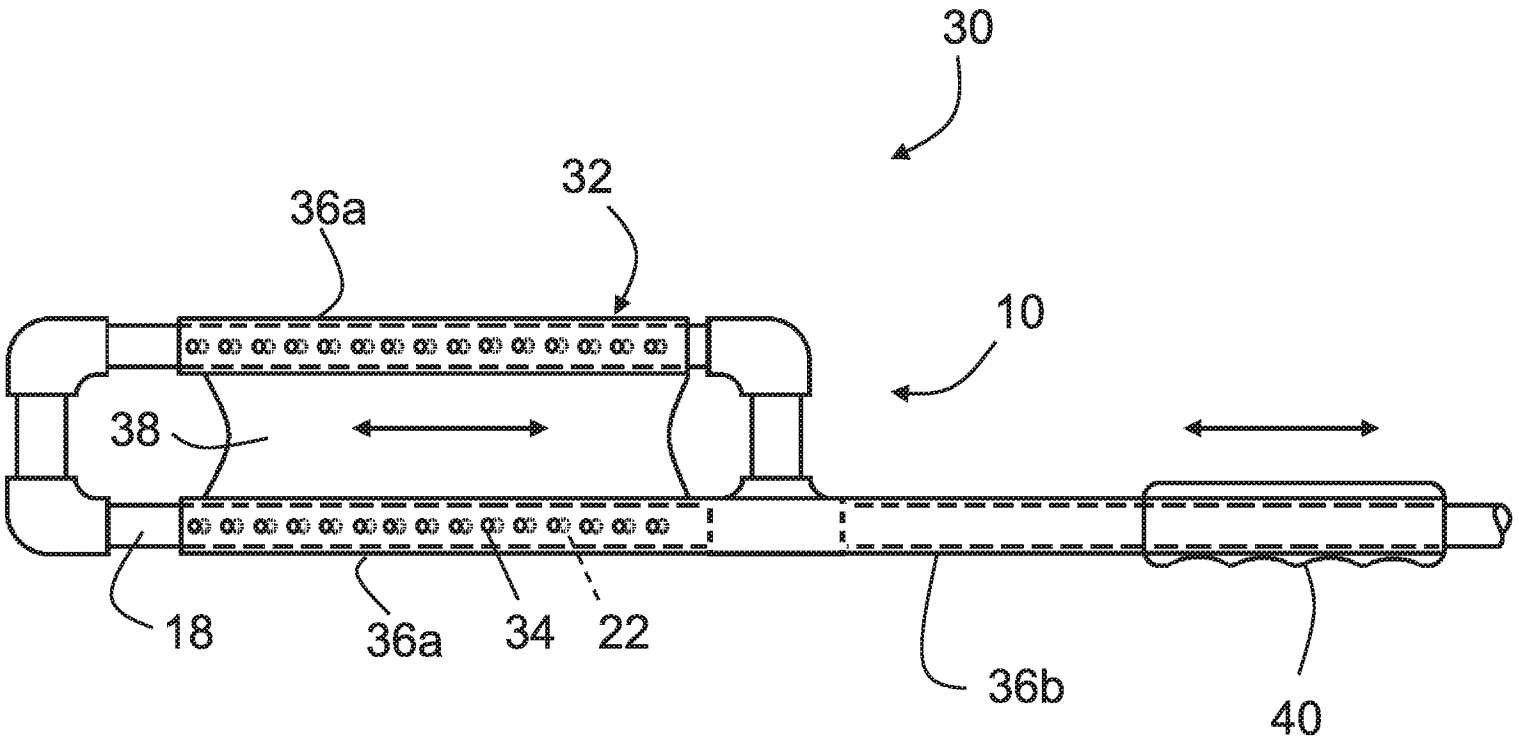
FIG. 1B is a second embodiment of a pool liner heating tool in accordance with the invention.

Referring now to FIG. 1B, there is illustrated another embodiment of a heating tool, shown generally at 30. The heating tool 30 is similarly structured to the heating tool 10 of FIG. 1A and additionally includes a fluid regulator, shown generally at 32. The fluid regulator 32 includes selectively coextensive regulating ports 34 that are configured to be brought into and out of alignment with the plurality of heating ports 22 of the manifold portion 14 in order to meter the flow of fluid delivered to the liner repair site. The fluid regulator 32 is configured as sliding sleeves 36*a* formed over the distribution rails 18 and an actuator sleeve 36*b* extending along the inlet tube 12*a*. The sleeves 36*a* are connected by a web 38 that permits coordinated movement in response to movement of the actuator sleeve 36*b* by a handle or lever 40.

Figure 2B:
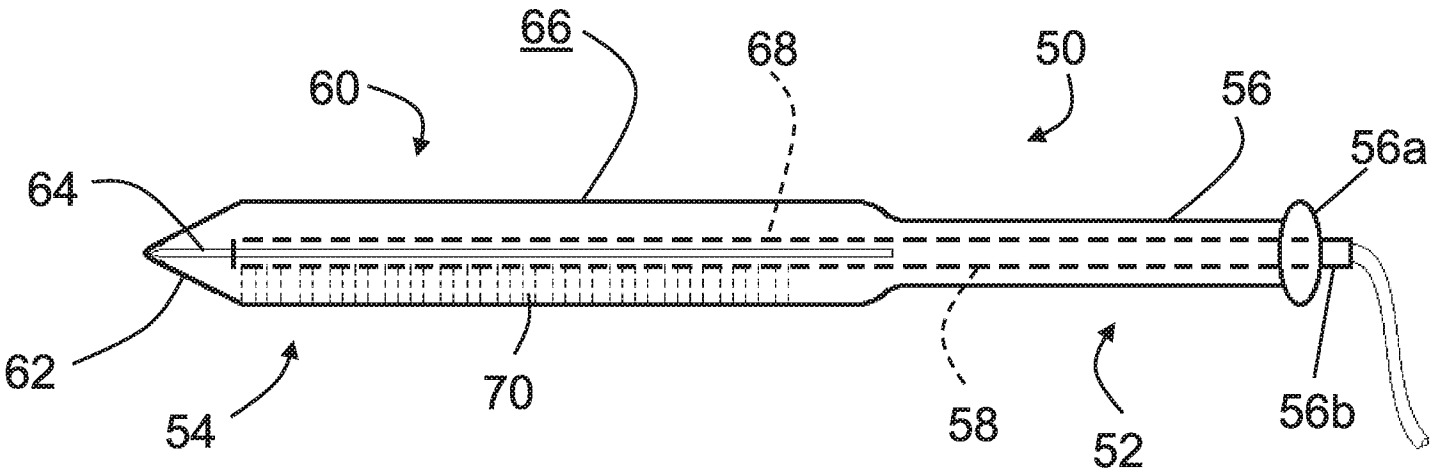
FIG. 2B is a side view of the pool liner heating tool of FIG. 2A.
Figure 2A:
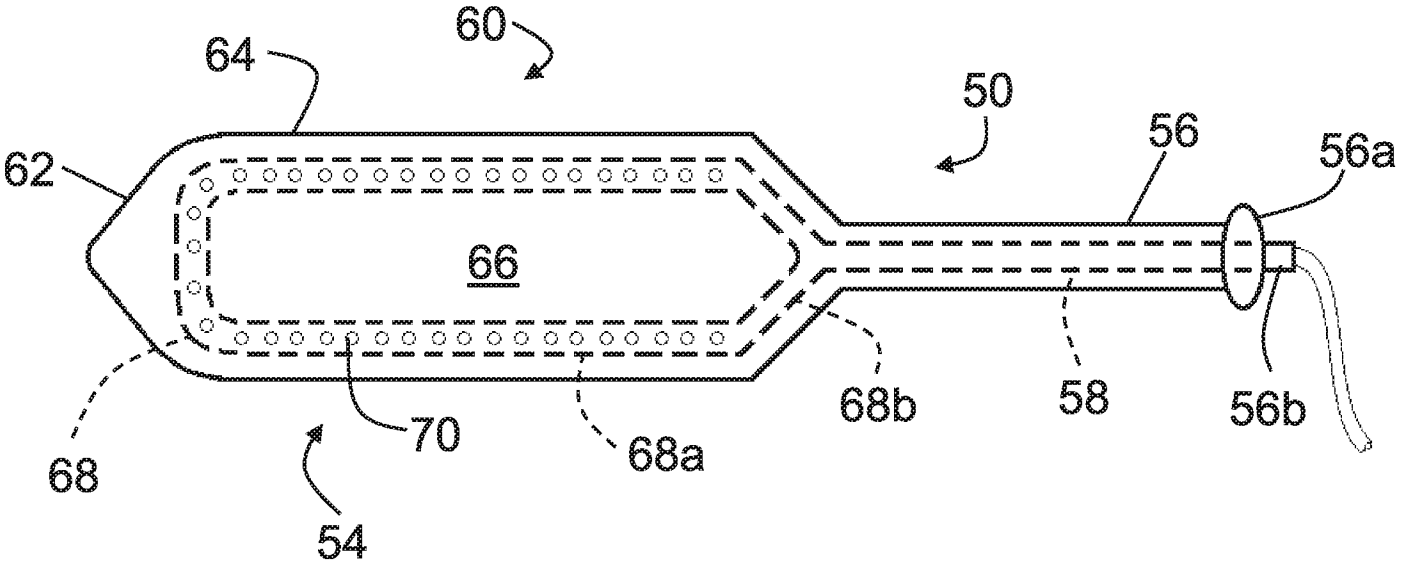
FIG. 2A is a plan view of a third embodiment of a pool liner heating tool in accordance with the invention.

Referring now to FIGS. 2A and 2B, there is illustrated another embodiment of a heating tool, shown generally at 50. The heating tool 50 includes a heat supply portion 52 and a manifold portion 54. The heat supply portion 52 defines a handle 56 with a co-axially formed inlet passage 58. The handle 56 terminates in a grip 56*a* to permit manipulation and movement of the heating tool 50 between the pool liner and the supporting side wall. A fluid line connection 56*b* is provided on the handle 56 and connects the inlet passage 58 with a heated fluid source 200.

The manifold portion 54 includes an outer body 60, configured in a paddle shape, having a tapered insert tip 62. The outer body 60 further may have a median perimeter line 64 that defines a taper or sloping surface contour from the outer body edge to the paddle face surface 66. These compound sloping surfaces provide a smooth profile for insertion and movement of the heating tool 50 between the liner and the pool side wall, particularly near or below the water line. Though described as being smooth, the surfaces may be formed as flat or may have a contour that follows the shapes of the internal passages. The manifold portion 54 further includes at least one heat distribution loop 68 having a thermal distribution rail 68*a* and may optionally include at least one return rail 68*b*. As illustrated, the return rail 68*b* provides a fluid connection between the inlet passage 58 and the distribution rail 68*a*. The distribution rail 68*a* includes a plurality of heat ports 70 extending through one side of the heating tool 50. In one method of manufacturing the heating tool 50, a high temperature plastic material may be blow molded to form the structure in a single piece.

Figure 3A:
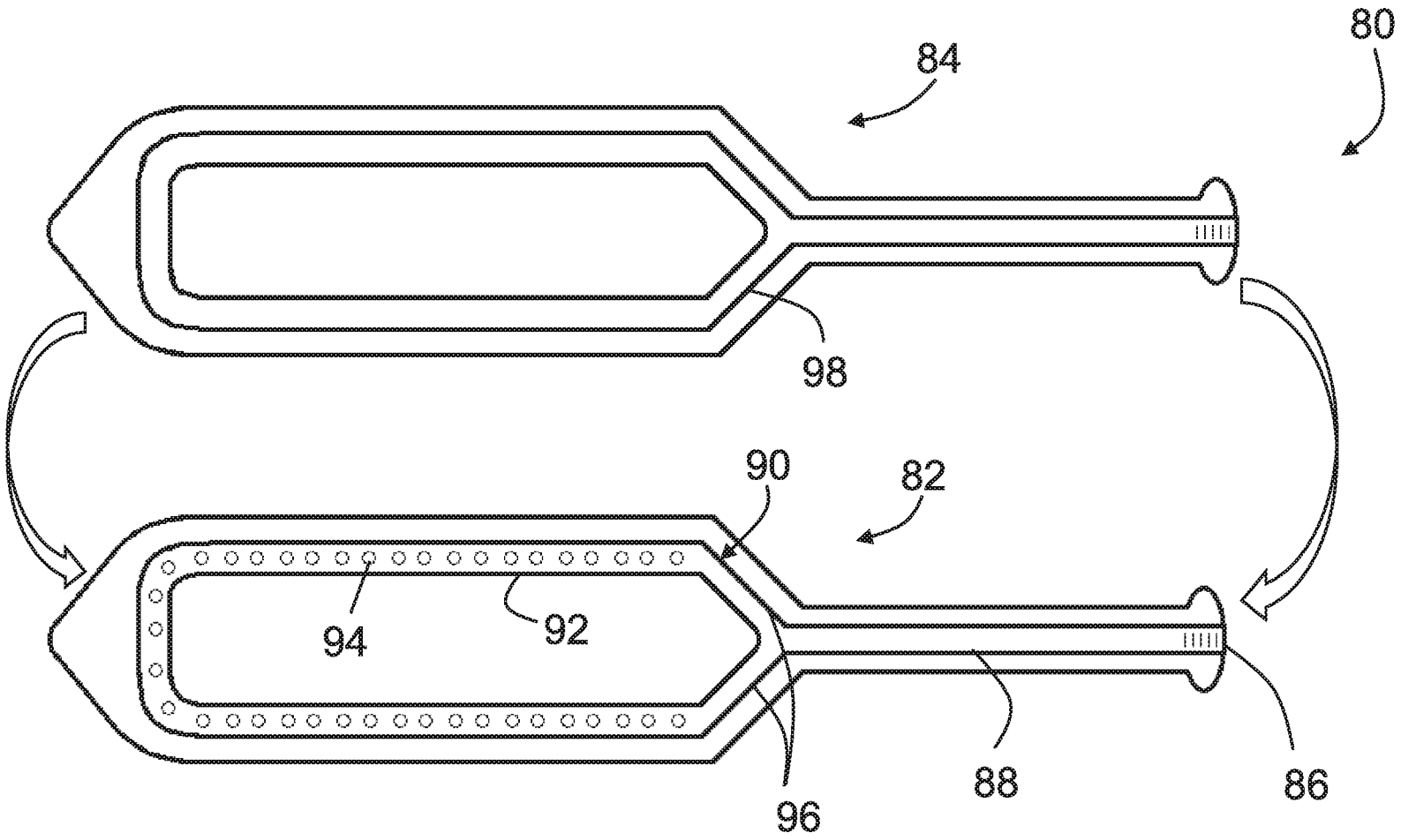
FIG. 3A is an exploded view of a fourth embodiment showing components forming the pool liner heating tool of FIGS. 2A and 2B.

Referring now to FIG. 3A, there is illustrated an embodiment of a heating tool 80, similar to the heating tool 50, and formed as two halves that are bonded together by either glue, ultrasonic welding, heat bonding or any other suitable attachment process. The heating tool 80 has a first half, configured as a fluid supply half 82, and a backing half 84. The fluid supply half 82 includes a fluid line connection 86 (shown as a threaded section) extending to an inlet passage 88. The inlet passage 88 forms a fluid connection with a closed loop passage 90 comprising a distribution rail 92 having a plurality of heat ports 94. A return rail 96 may be provided to fluidly connect the inlet passage 88 to the distribution rail 92. Alternatively, the inlet passage 88 may connect directly to the distribution rail 92 to form the manifold piping section.

The backing half 84 is illustrated having a mating passage section 98 that follows the inlet passage 88, distribution rail 92, return rail 96 in order to provide a complete cross section of the manifold piping. The backing half 84 may alternatively be flat and configured to close off the piping as formed in the fluid supply half 82.

Figure 3B:
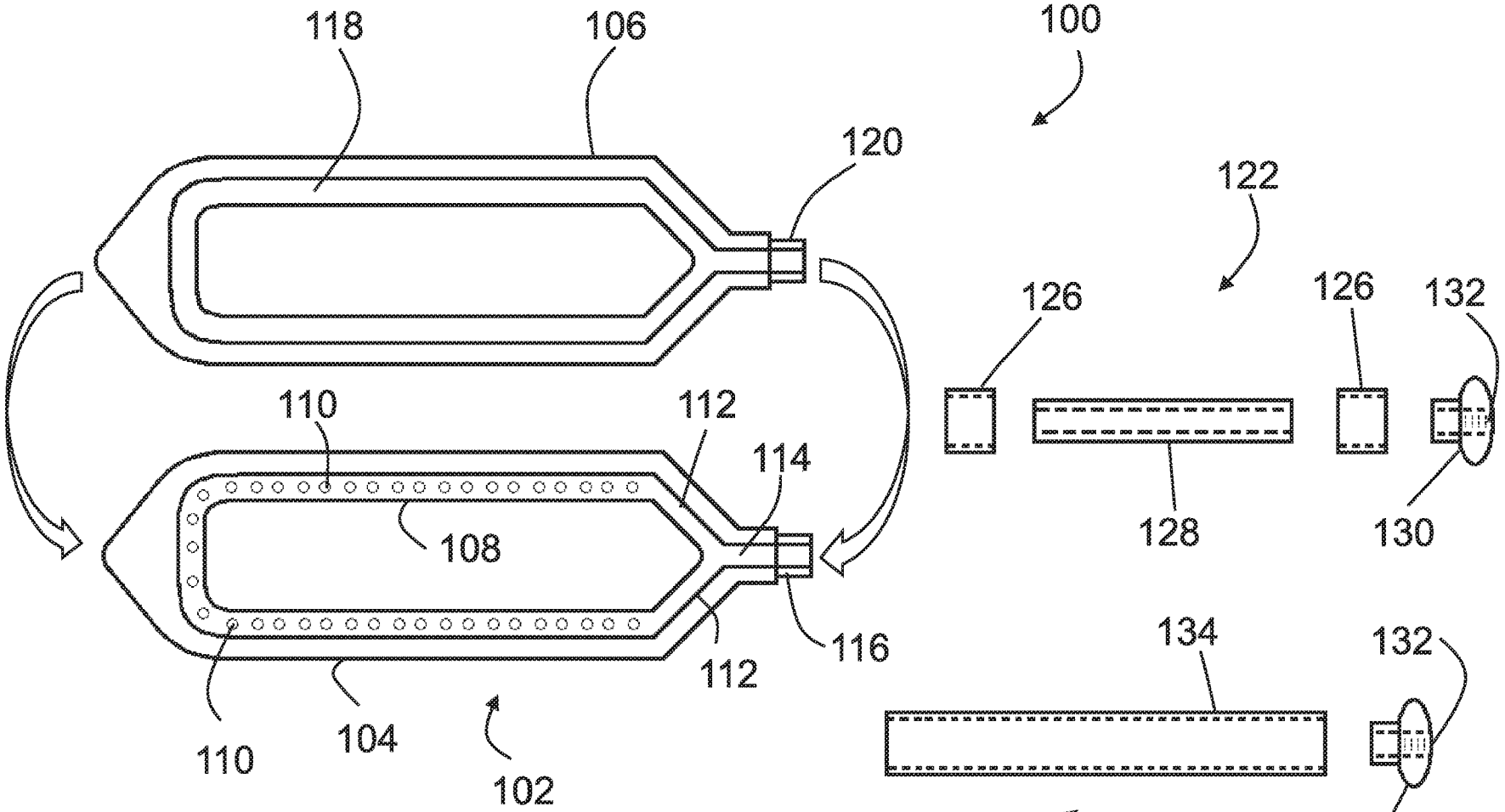
FIG. 3B is an exploded view of a fifth embodiment showing components forming the pool liner heating tool of FIGS. 2A and 2B.

Referring now to FIG. 3B, there is illustrated another embodiment of a heating tool 100, similar to the heating tool 50, having a manifold section 102 formed as a fluid supply half 104 and a backing half 106. The manifold section 102 is illustrated as having a paddle shape contour similar to the heating tool 80. The two halves—the fluid supply half 104 and the backing half 106—are configured to be attached together to form the manifold section 102. The halves may be attached by adhesive bonding, ultrasonic welding, or any suitable attachment process. Alternatively, the manifold section 102 may be blow molded as a single piece unit that incorporates the fluid supply half 104 and the backing half 106 as a single closed component. The fluid supply half 104 includes a distribution rail 108 having a plurality of heat ports 110 formed therethrough. The distribution rail 108 connects to a return rail 112 that further connects to an inlet passage 114. The inlet passage 114 terminates in a mounting stem 116.

The backing half 106 includes a mating passage section 118 that forms a complementary fluid passageway to complete the inlet passage 114, distribution rail 108, and return rail 112 in order to provide a complete cross section of the manifold piping. The mating passage section 118 terminates in a mounting stem 120 similar to the mounting stem 116. When the two halves are brought together, the mounting stems 116 and 120 cooperate to permit a handle section 122 or an alternative handle section 124 to be attached thereto. The handle sections 122 or 124 provide an additional attachment feature by providing a continuous outer fit over the mated stems 116 and 120. In the illustrated handle section embodiment 122, a union 126 couples to the mated stems 116/120 and a tube section 128 attaches to the union 126 in a manner known during the assembly of PVC piping. Another union 126 is provided to attach the tube section 128 to a handle knob 130. The handle knob 130 includes a fluid line connection 132 (shown as a threaded section) for coupling the heated fluid source 200. Alternatively, the handle section 124 may be formed from a tube section 134 that forms a desired connection to the mated stems 116/120 and the handle knob 130 without the use of unions 126.

Referring now to FIG. 4, there is illustrated an embodiment of a heating tool, shown generally at 150, that includes any or all of the features described in conjunction with the various heating tools 10, 30, 50, 80, and/or 100, in the environment of a pool structure 180 having a detached liner section 182. The heating tool 150 is connected to the heated fluid source 200, which may provide heated water or air to the tool 150. In the illustrated embodiment, the heating tool 150 includes a regulator that controls at least one of the fluid temperature, the fluid flow, and/or the fluid flow rate of heated fluid to the tool 150. In addition, the heated fluid source may also monitor the liner temperature to prevent overheating of the material. The heating tool 150 is inserted between the liner 180 and side wall 190. The regulator is activated and heated fluid passes between the liner 180 and the side wall 190 to soften the liner material. As the tool 150 is moved along the liner/side wall interface, both laterally and vertically, the liner material can be worked and stretched into conformance with the upper sidewall edge 192 and attached under the cove molding 194 to secure the repair.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A heating tool for thermally manipulating an installed pool liner layer, the tool comprising:

a manifold portion having a wall and a thermal distribution rail that includes a plurality of heat ports extending through the wall, the manifold portion includes an outer body configured in a paddle shape having a tapered insert tip, the outer body having a median perimeter line that defines a continuous, solid surface contour from an edge of the outer body to a paddle face surface that facilitates insertion between the pool liner layer and the supporting side wall above and below a water line level and a rigidity characteristic configured to pass the manifold portion between the installed pool liner layer and a supporting side wall, and the rigidity characteristic of the manifold portion maintaining the shape during manipulation and movement of the heating tool between the pool liner layer and the side wall; and a heat supply portion including a handle with a co-axially formed inlet passage in fluid communication with a fluid line connection that connects the inlet passage with a heated fluid source capable of localized softening of the installed pool liner layer.

2. The heating tool of claim 1 wherein the manifold portion includes a return rail configured to create a closed-loop heated fluid passageway, the return rail in fluid communication with the inlet passage.

3. The heating tool of claim 1 wherein the tapered insert tip defines a tapered profile in at least one of the edge of the outer body or the paddle face surface.

4. The heating tool of claim 1 wherein the handle terminates in a grip that facilitates inserting and manipulating the manifold portion between the pool liner layer and the side wall.

5. The heating tool of claim 4 wherein the handle is configured to insulate against heat emanating from the inlet passage.

6. The heating tool of claim 1 wherein the manifold portion is configured as a fluid supply half and a backing half configured to be attached together to define the distribution rail and an inlet passage.

7. The heating tool of claim 6 wherein the inlet passage of the manifold portion forms a fluid connection with the inlet passage of the handle.

8. The heating tool of claim 3 wherein the tapered profile is a compound tapered profile.

* * * * *